US009396896B2

(12) United States Patent
Chen et al.

(10) Patent No.: US 9,396,896 B2
(45) Date of Patent: Jul. 19, 2016

(54) MODULAR VACUUM INTERRUPTION APPARATUS

(71) Applicant: EATON CORPORATION, Cleveland, OH (US)

(72) Inventors: Steven Zhenghong Chen, Moon Township, PA (US); Anthony Thomas Ricciuti, Bethel Park, PA (US); Liping Ye, Changzhou (CN); Brad Robert Leccia, Bethel Park, PA (US)

(73) Assignee: EATON CORPORATION, Cleveland, OH (US)

( * ) Notice: Subject to any disclaimer, the term of this patent is extended or adjusted under 35 U.S.C. 154(b) by 59 days.

(21) Appl. No.: 14/299,080

(22) Filed: Jun. 9, 2014

(65) Prior Publication Data

US 2015/0357136 A1 Dec. 10, 2015

(51) Int. Cl.

| | |
|---|---|
| ***H01H 33/666*** | (2006.01) |
| ***H01H 33/664*** | (2006.01) |
| ***H01H 9/08*** | (2006.01) |
| ***H01H 33/66*** | (2006.01) |
| *H01H 33/662* | (2006.01) |

(52) U.S. Cl.

CPC ..... *H01H 33/664* (2013.01); *H01H 9/08* (2013.01); *H01H 33/6606* (2013.01); *H01H 33/666* (2013.01); *H01H 2033/6623* (2013.01); *H01H 2033/6665* (2013.01)

(58) Field of Classification Search

CPC ..... H01H 33/6606; H01H 2033/6623; H01H 33/66; H01H 33/666; H01H 71/08

See application file for complete search history.

(56) References Cited

U.S. PATENT DOCUMENTS

| | | | | |
|---|---|---|---|---|
| 5,808,258 | A * | 9/1998 | Luzzi | H01H 33/66207 218/136 |
| 6,242,708 | B1 | 6/2001 | Marchand et al. | |
| 7,285,743 | B2 * | 10/2007 | Martin | H01H 33/027 218/136 |
| 7,910,852 | B2 * | 3/2011 | Chen | H01H 33/6606 218/119 |

(Continued)

FOREIGN PATENT DOCUMENTS

EP 2 161 729 A2 3/2010

OTHER PUBLICATIONS

European Patent Office, "International Search Report and Written Opinion for PCT/US2015/024443", Jul. 3, 2015, 10 pp.

*Primary Examiner* — Truc Nguyen

(74) *Attorney, Agent, or Firm* — Eckert Seamans Cherin & Mellott, LLC; Brij K. Agarwal; Grant E. Coffield

(57) ABSTRACT

An improved modular vacuum interruption apparatus includes a vacuum interrupter, a first connection module, and a second connection module, with the first and second connection modules each being connectable and disconnectable with a pair of electrodes of the vacuum interrupter. The first connection module is selected from among a plurality of connection modules that are similar yet different and can be used interchangeably to form various permutations of the improved modular vacuum interruption apparatus. The second connection module is likewise selected from among a plurality of connection modules that are similar yet different and that are interchangeably usable with the vacuum interrupter to form different permutations of the modular vacuum interruption apparatus. Similarly, the vacuum interrupter is among a plurality of vacuum interrupters having different specifications but that are usable interchangeably with all of the first and second connection modules to form different permutations of the modular vacuum interruption apparatus.

11 Claims, 6 Drawing Sheets

(56) References Cited

U.S. PATENT DOCUMENTS 8,309,872 B2 * 11/2012 Peter ..... H01H 33/666
218/118
8,729,417 B2 * 5/2014 Humpert ..... B29C 45/14639
218/118
2002/0043516 A1 * 4/2002 Morita ..... H01H 33/66207
218/118
2008/0041825 A1 * 2/2008 Stoving ..... H01H 33/66207
218/120
2009/0200270 A1 * 8/2009 Chen ..... H01H 33/6606
218/119
2010/0246102 A1 * 9/2010 Martin ..... H01H 33/66207
361/605
2013/0092658 A1 * 4/2013 Ache ..... H01H 33/66207
218/139

* cited by examiner

MODULAR VACUUM INTERRUPTION APPARATUS

BACKGROUND

1. Field

The disclosed and claimed concept relates generally to electrical distribution equipment and, more particularly, to a modular vacuum interruption apparatus usable therewith.

2. Related Art

Electrical distribution equipment is well known in the related art. Such electrical distribution equipment is known to include current interruption devices such as circuit breakers, vacuum interrupters, and the like. Such interruption devices are intended to interrupt the flow of current through a circuit in certain predefined conditions such as overcurrent conditions, under-voltage conditions, and other conditions, all in a known fashion.

Vacuum interrupters are understood in the relevant art to include within an evacuated envelope a pair of separable electrical contacts that include a movable contact and a stationary contact. When the current flowing through the vacuum interrupter is desired to be interrupted, a linkage or other type of drive mechanism that is situated generally at the exterior of the evacuated envelope moves the movable contact away from the stationary contact. The absence of air within the evacuated envelope facilitates the rapid extinction of any arc that may be formed between the movable and stationary contacts in a known fashion. While such vacuum interrupters have been generally effective for their intended purposes, they have not been without limitation. Improvements are therefore desirable.

SUMMARY

An improved modular vacuum interruption apparatus includes a vacuum interrupter, a first connection module, and a second connection module, with the first and second connection modules each being connectable and disconnectable with a pair of electrodes of the vacuum interrupter. The first connection module is selected from among a plurality of connection modules that are similar yet different and can be used interchangeably to form various permutations of the improved modular vacuum interruption apparatus. The second connection module is likewise selected from among a plurality of connection modules that are similar yet different and that are interchangeably usable with the vacuum interrupter to form different permutations of the improved modular vacuum interruption apparatus. Similarly, the vacuum interrupter is among a plurality of vacuum interrupters having different specifications but that are usable interchangeably with all of the first and second connection modules to form different permutations of the improved modular vacuum interruption apparatus.

Accordingly, an aspect of the disclosed and claimed concept is to provide an improved modular vacuum interruption apparatus that is formed of multiple interchangeable components that are each individually encapsulated within a solid insulator.

Another aspect of the disclosed and claimed concept is to provide an improved modular vacuum interruption apparatus that is formed of multiple interchangeable components that can be assembled together and disassembled to create various permutations of the vacuum interruption apparatus.

Another aspect of the disclosed and claimed concept is to provide numerous components such as vacuum interrupters and connection modules that can be employed interchangeably to create various permutations of such a modular vacuum interruption apparatus.

Another aspect of the disclosed and claimed concept is to provide numerous permutations of such a modular vacuum interruption apparatus having components such as vacuum interrupters and connection modules wherein the connection modules of each assembled vacuum interruption apparatus are physically unconnected with one another and that at most have the vacuum interrupter physically disposed therebetween.

Another aspect of the disclosed and claimed concept is to provide various components from a component collection that are usable with other components to form various permutations of such a modular vacuum interruption apparatus.

Another aspect of the disclosed and claimed concept is to provide various components to form various permutations of a modular vacuum interruption apparatus that are usable to connect with different electrical circuits and/or to be operable with different electrical equipment and/or to possess different specifications.

Another aspect of the disclosed and claimed concept is to provide a modular vacuum interruption apparatus formed from a plurality of connectable and disconnectable components that can be interchanged with other components that may be the result of a design change or other change to the components themselves or to the electrical equipment to which the modular vacuum interruption apparatus is electrically connected.

These and other aspects of the disclosed and claimed concept are provided by an improved vacuum interruption apparatus that is structured to be electrically connected with an electrical circuit and that is movable between an OPEN condition and a CLOSED condition. The vacuum interruption apparatus can be generally stated as including a vacuum interrupter having a first electrode and a second electrode, a first connection module having a first insulator, a first connector, and a first terminal, the first connector and the first terminal being electrically connected together and being disposed on the first insulator, the first connector being electrically connected with the first electrode, the first terminal being structured to be electrically connected with one of a line side conductor and a load side conductor of the circuit, a second connection module having a second insulator, a second connector, and a second terminal, the second connector and the second terminal being electrically connected together and being disposed on the second insulator, the second connector being electrically connected with the second electrode, the second terminal being structured to be electrically connected with the other of a line side conductor and a load side conductor of the circuit, and the first and second insulators being mechanically unconnected with one another.

Other aspects of the disclosed and claimed concept are provided by an improved connection module that is structured to be electrically connected with an electrode of a vacuum interrupter which is movable between an OPEN condition and a CLOSED condition and which is structured to be electrically connected with an electrical circuit. The connection module can be generally stated as including an insulator, a connector, and a terminal, the connector and the terminal being electrically connected together and being disposed on the insulator, the connector being electrically connectable with the electrode and being electrically disconnectable from the electrode, the terminal being structured to be electrically connected with one of a line side conductor and a load side conductor of the electrical circuit.

BRIEF DESCRIPTION OF THE DRAWINGS

A further understanding of the disclosed and claimed concept can be gained from the following Description when read in conjunction with the accompanying drawings in which:

Similar numerals refer to similar parts throughout the specification.

DESCRIPTION

Figure 1:
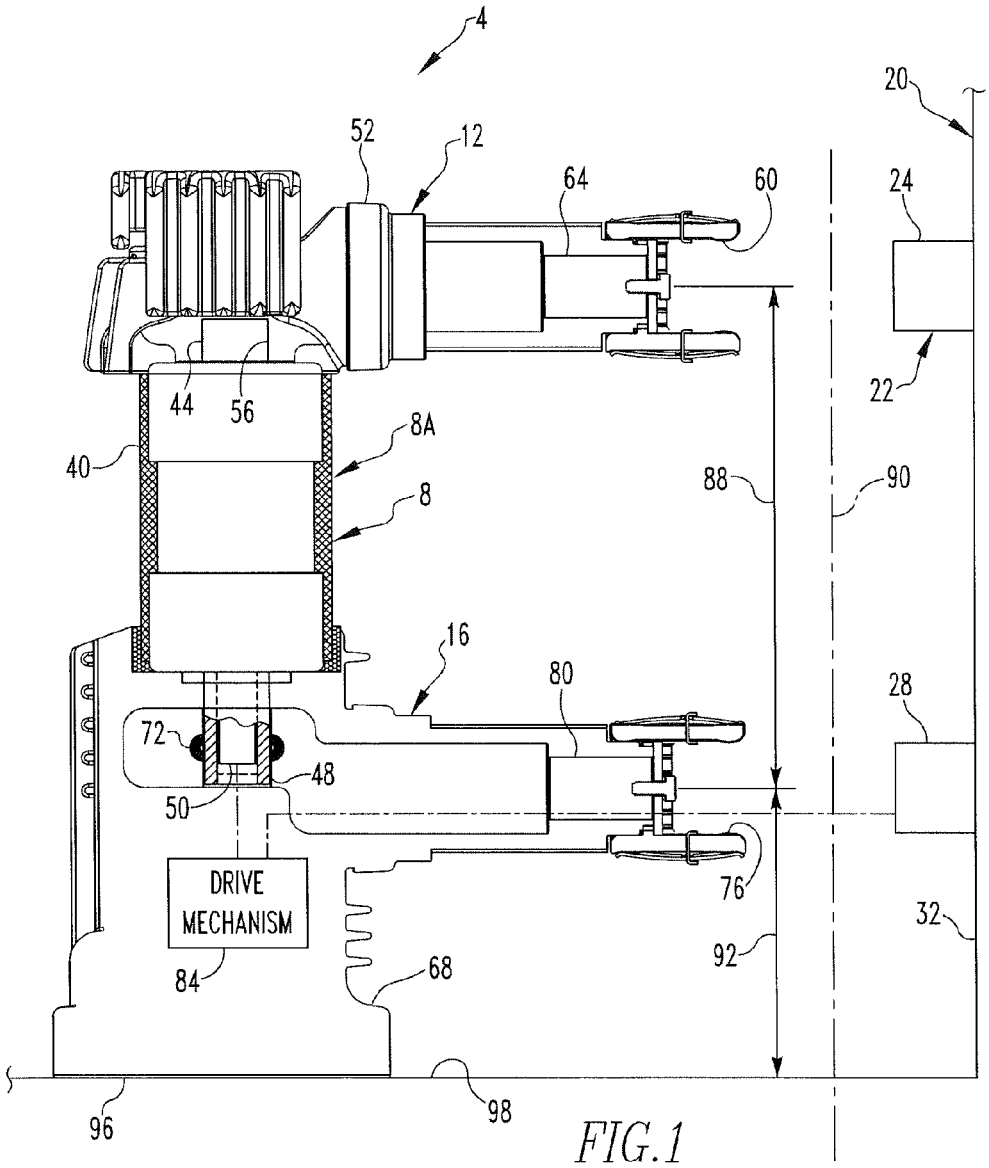
FIG. 1 is an elevational view of a first permutation of an improved vacuum interruption apparatus in accordance with the disclosed and claimed concept.
Figure 3:
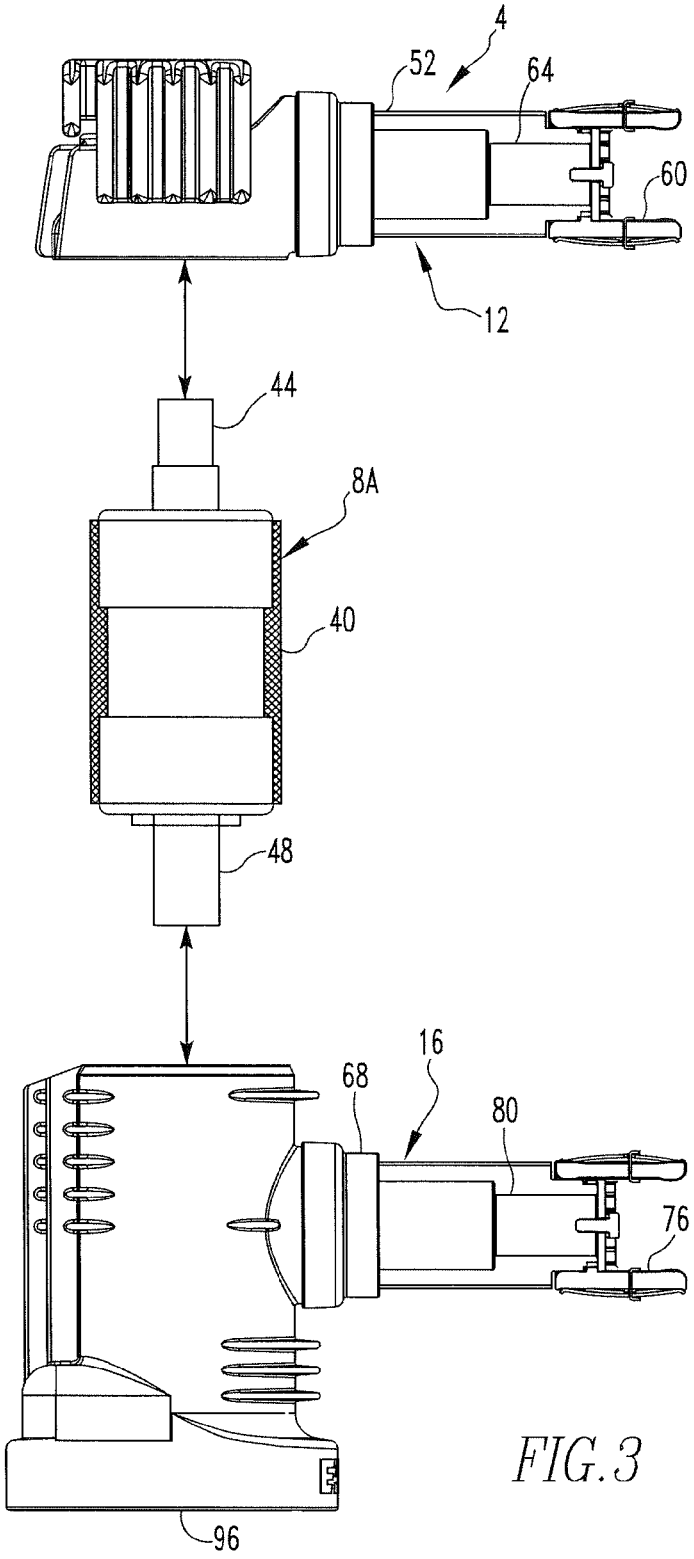
FIG. 3 is an exploded elevation view, partially cut away, of the permutation of the vacuum interruption apparatus permutation of FIG. 1.

A first permutation of an improved modular vacuum interruption apparatus 4 is depicted in FIGS. 1 and 3. The first permutation of the vacuum interruption apparatus 4 can be said to include a vacuum interrupter 8A, a first connection module 12, and a second connection module 16. The vacuum interruption apparatus 4 is connectable with a piece of electrical equipment 20 to complete a portion of a circuit 22 that includes a line side conductor 24 and a load side conductor 28 that are disposed on a housing 32 of the piece of electrical equipment 20. The vacuum interruption apparatus 4 is connectable with the circuit 22 to complete at least a portion of the circuit 22 and is operable to switch the circuit 22 between an OPEN condition and a CLOSED condition.

The components that form the first permutation of the vacuum interruption apparatus 4, i.e., the vacuum interrupter 8A, the first connection module 12, and the second connection module 16, are selected from among a plurality of different components which together form a component collection 36. That is, the exemplary component collection 36 includes the first connection module 12 but additionally includes a pair of other first connection modules 112 and 212 that will be described in greater detail below. While the first connection modules 12, 112, and 212 are similar, they are also different.

The vacuum interrupter 8A that is depicted in FIGS. 1 and 3 is one of a plurality of vacuum interrupters that additionally include a vacuum interrupter 8B, a vacuum interrupter 8C, and a vacuum interrupter 8D, which may be individually or collectively referred to herein with the numeral 8. In the depicted exemplary embodiment, the vacuum interrupters 8 each have the same external physical dimensions but have different specifications, such as different interruptions ratings, by way of example.

In addition to the second connection module 16, the component collection 36 further includes another second connection module 316. The second connection modules 16 and 316 are likewise similar yet different.

Figure 4:
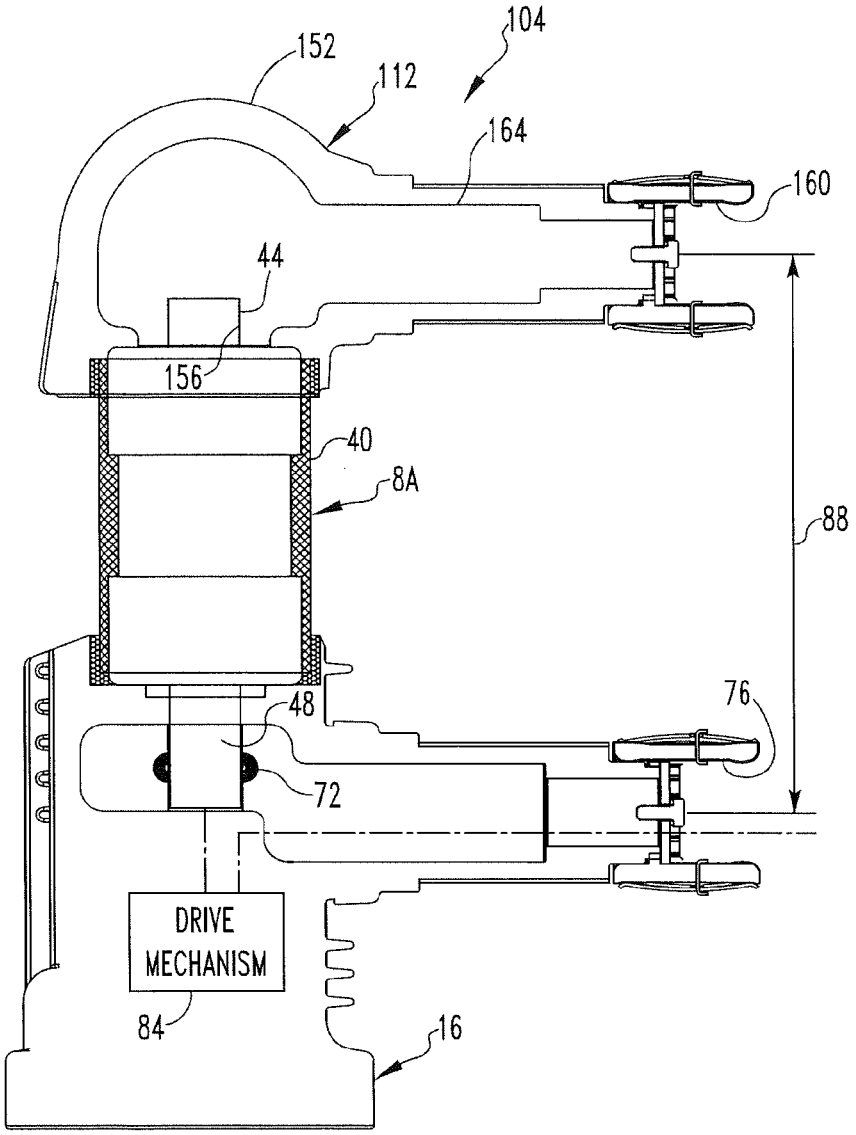
FIG. 4 is an elevational view, partially cut away, of a second permutation of the improved vacuum interruption apparatus.
Figure 5:
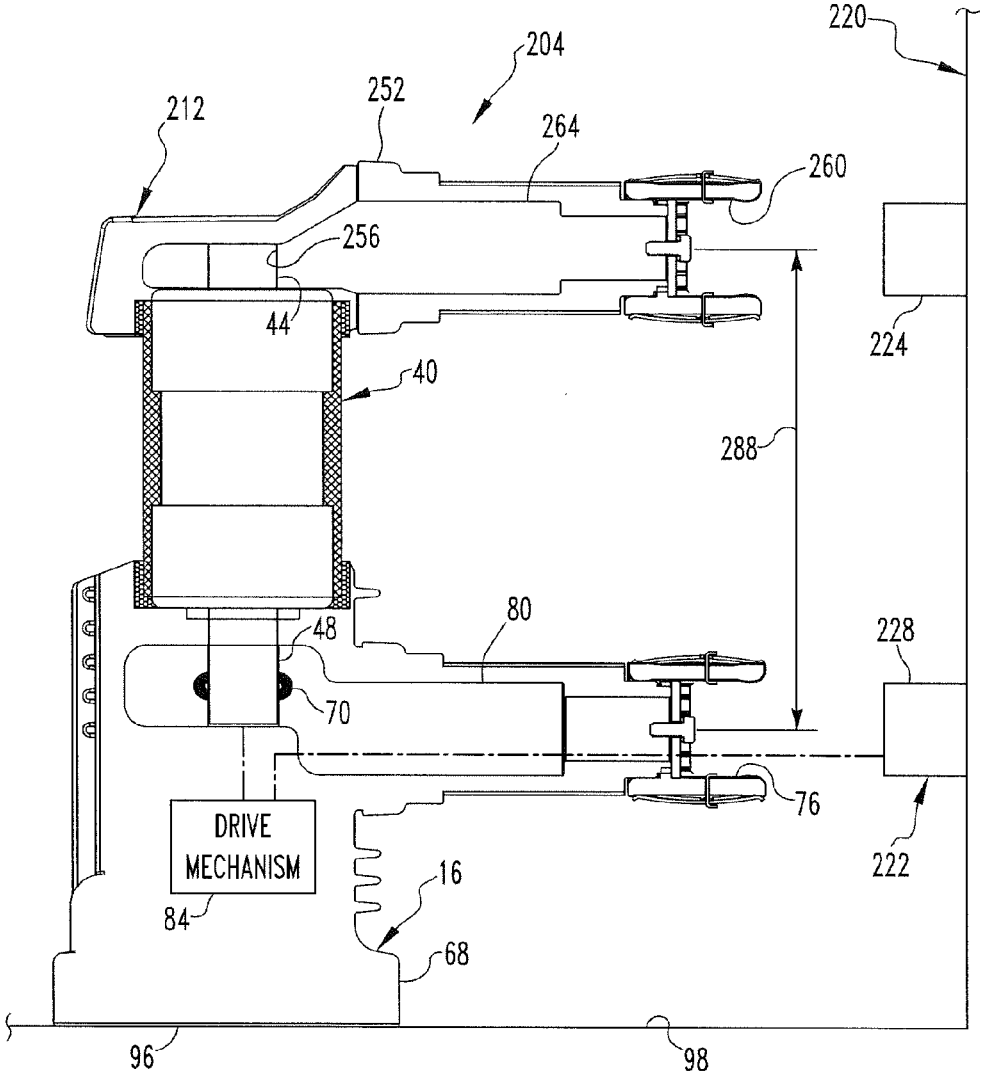
FIG. 5 is an elevational view, partially cut away, of a third permutation of the improved vacuum interruption apparatus.
Figure 6:
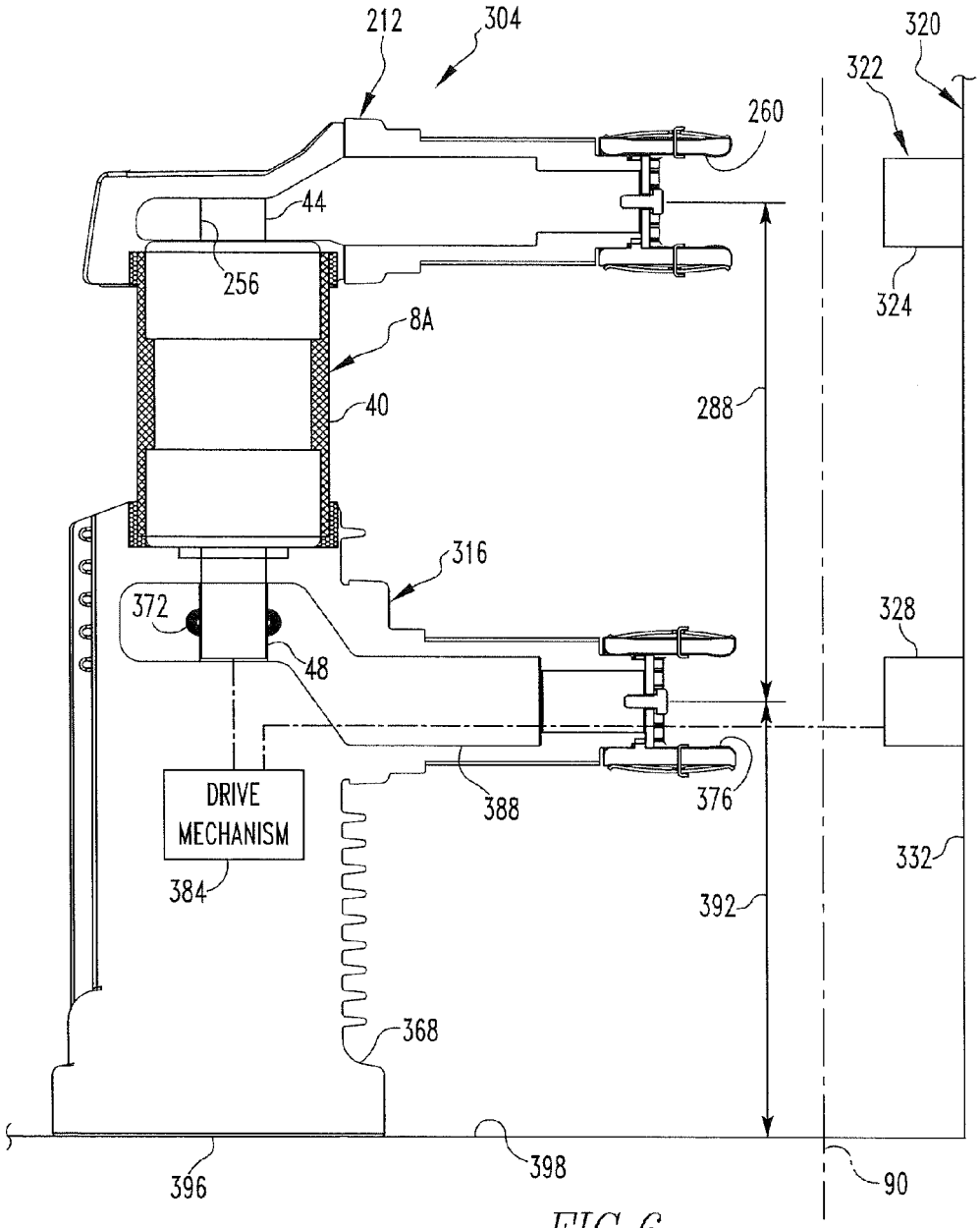
FIG. 6 is an elevational view, partially cut away, of a fourth permutation of the improved vacuum interruption apparatus.

It is understood that the depicted component collection 36 is merely exemplary in nature and is not intended to be limiting as to the quantity or variations of the various components that make up the component collection 36. As will be set forth in greater detail below, the various components of the component collection 36 can be interchangeably and alternatively connected to one another and disconnected from one another to form a plurality of permutations of the components which, when assembled together, form a variety of permutations of vacuum interruption apparatuses that are modular and that are in accordance with the disclosed and claimed concept. The vacuum interruption apparatus 4 is merely a first exemplary permutation of a selected subset of the components in the component collection 36. While three further exemplary permutations of improved vacuum interruption apparatuses are depicted in FIGS. 4, 5, and 6 and are designed with the numerals 104, 204, and 304, respectively, it is understood that the components of the component collection 36 can be combined in any of a variety of fashions to form any of a variety of permutations of the vacuum interruption apparatus that may or may not be expressly depicted herein.

The vacuum interrupter 8A includes an interruption element 40, a first electrode 44, and a second electrode 48. The interruption element 40 includes an evacuated envelope within which are disposed a set of contacts that are not expressly depicted herein but that include a stationary contact and a movable contact. The first electrode 44 is electrically connected with the stationary contact, and the second electrode 48 is electrically connected with the movable contact. As is depicted in FIG. 1, the second electrode 48 in a known fashion includes a reciprocating element 50 that is movable to switch the vacuum interrupter 8A between an OPEN condition and a CLOSED condition, both of which are depicted in FIG. 1, one of which being depicted in dashed lines. For reasons of simplicity of disclosure, the vacuum interrupter 8A is depicted as being employed in all of the vacuum interruption apparatus permutations 4, 104, 204, and 304, although it is understood that any of the vacuum interrupters 8B, 8C, and 8D could alternatively be used in any of the aforementioned permutations or other permutations of the vacuum interruption apparatus.

The first connection module 12 includes a first insulator 52 upon which are disposed a first connector 56 and a first terminal 60 that are electrically connected together via a first conduction element 64. The first connector 56 is mechanically and electrically connectable and disconnectable with the first electrode 44. The first terminal 60 is likewise mechanically and electrically connectable to and disconnectable from the line side conductor 24 of the piece of equipment 20. The first connector 56 and the first terminal 60 are largely encapsulated within the solid insulation material that forms the first insulator 52, excepts that the portion of the first connector 56 that is connectable with the first electrode 44 and the portion of the first terminal 60 that is connectable with the line side conductor 24 are not encapsulated and rather are exposed.

The second connection module 16 includes a second insulator 68 upon which are disposed a second connector 72 and a second terminal 76 that are electrically connected together via a second conduction element 80. The second connector 72 is mechanically and electrically connectable and disconnectable with the second electrode 48. The second terminal 76 is likewise mechanically and electrically connectable to and disconnectable from the line side conductor 28 of the piece of equipment 20. The second connector 72 and the second terminal 76 are largely encapsulated within the solid insulation material that forms the second insulator 68, excepts that the portion of the second connector 72 that is connectable with the second electrode 48 and the portion of the second terminal 76 that is connectable with the line side conductor 28 are not encapsulated and rather are exposed.

The substantial encapsulation of the first connector 72 and the first terminal 56 in the first insulator 60 and the substantial encapsulation of the second connector 72 and the second terminal 76 in the second insulator 68 enables adjacent poles of the piece of equipment 20 to be positioned relatively closer together than would be possible if such conductive components were exposed.

The second connection module 16 further includes a drive mechanism 84 that is operatively connected with the reciprocating element 50 and with other equipment of the piece of equipment 20 that is not expressly depicted herein. The drive mechanism 84 is operable to move the reciprocating element 50 between its two positions that correspond with the OPEN and CLOSED conditions of the vacuum interrupter 8A.

When the first and second connection modules 12 and 16 are connected with the vacuum interrupter 8A to form the vacuum interruption apparatus first permutation 4, as is depicted generally in FIG. 1, the first and second terminals 60 and 76 can be said to be spaced apart by a terminal distance that is represented by a first distance 88 in FIG. 1. The first distance 88 is measured along an axis 90. The first distance 88 is equal to the distance between the line side and load side conductors 24 and 28. It thus can be seen that the first and second terminals 60 and 76 are positioned with respect to one another to permit their electrical and mechanical connection with the piece of electrical equipment 20.

It can also be seen from FIG. 1 that an external surface 96 of the second insulator 68 is spaced from the second terminal 76 by a second distance 92 that is likewise measured along the axis 90. The second insulator 68 and, more particularly, the external surface 96, is configured to enable the second connection module 16 to be accommodated adjacent a ledge 98 of the housing 32. That is, the exemplary housing 32 or other factors affecting the physical dimensions of the piece of electrical equipment 20 are represented by the ledge 98, and the external surface 96 is advantageously configured so that the vacuum interruption apparatus 4 and the ledge 98 do not interfere with one another. Further in this regard, it is understood that the various components of the vacuum interruption apparatus 4 are configured to enable it to fit within the physical confines or limitations that exist with the piece of electrical equipment 20.

When the vacuum interruption apparatus 4 is assembled, the first and second insulators 52 and 68 are physically directly unconnected with one another and, in the depicted exemplary embodiment, are spaced apart from one another. More specifically, the vacuum interrupter 8 can generally be said to be disposed between the first and second insulators 52 and 68 despite the fact that the first and second connection modules 12 and 16 are, or at least can be, electrically connected together via the interruption element 40. Stated otherwise, while the first and second connection modules 12 and 16 may be electrically connected together via the vacuum interrupter 8 and may be indirectly physically connected together since they are both physically connected with the vacuum interrupter 8, the first and second connection modules 12 and 16 are considered to be unconnected with one another because no direct physical connection exists between them when the vacuum interruption apparatus 4 is assembled.

It thus can be understood that the vacuum interrupter 8A, the first connection module 12, and the second connection module 16 are each discrete components that are mechanically and electrically connectable together and are disconnectable from one another. That is, the first and second connection modules 12 and 16 are mechanically and electrically connectable with the vacuum interrupter 8A, although it is reiterated that the first and second connection modules 12 and 16 are not directly connected together and rather are at most only indirectly connected together due to vacuum interrupter 8A being intermediate the first and second connection modules 12 and 16.

When the components of the vacuum interruption apparatus 4 are connected together, the assembled vacuum interruption apparatus 4 can be electrically and mechanically connected with the circuit 22 and is operable to switch the connected portion of the circuit between OPEN and CLOSED conditions. If the vacuum interruption apparatus 4 should fail for any reason, it can be disconnected from the piece of equipment 20, and the first and second connection modules 12 and 16 can be disconnected from the vacuum interrupter 8A. The various components can then each be tested to determine whether one of the components is faulty, for instance, and should therefore be replaced. By forming the vacuum interruption apparatus 4 to be of a modular configuration out of a plurality of components that are individually connectable and disconnectable from one another and that are interchangeable with other such components, the entire vacuum interruption apparatus 4 need not be discarded if only a single component thereof is not operational. This desirably saves cost.

Moreover, it can be understood that the modular nature of the vacuum interruption apparatus 4 enables its various components to be interchanged with other components that are similar yet different in order to enable the vacuum interruption apparatus in different forms to be used in different applications. For example, and as is depicted generally in FIG. 4, the first connection module 12 can be replaced with another first connection module 112 which, in combination with the vacuum interrupter 8A and the second connection module 16, together form another exemplary permutation of the vacuum interruption apparatus 104. The exemplary second permutation of the vacuum interruption apparatus 104 is, in the depicted exemplary embodiment, intended to illustrate how an engineering change or other change can be incorporated into the first connection module 112. As such, the first connection module 12 can be replaced with the first connection module 112 whereby the overall modified vacuum interruption apparatus 104 can still be connected with the piece of electrical equipment 20. That is, the engineering change can be implemented into the vacuum interruption apparatus 104 by incorporating the change into a single component that is modularly connectable with other components, which reduced the cost of implementing the engineering change.

The first connection module 112 is similar to the first connection module 12 and includes a first insulator 152 upon which are disposed a first connector 156 and a first terminal 160 that are electrically connected together via a first conduction element 164. The first connector 156 is connected with the first electrode 44. While the first insulator 152 is of a slightly different configuration than the first insulator 52, it can be seen that the terminal distance indicated between the first terminal 160 and the second terminal 76 is the same first distance 88 as in the vacuum interruption apparatus 4. As such, the vacuum interruption apparatus 104 can unquestionably be connected with the circuit 22 of the piece of electrical equipment 20. It thus can likewise be understood that the various components of the component collection 36 can be selected to suit various needs of various applications.

For example, FIG. 5 depicts a third permutation of the vacuum interruption apparatus at the numeral 204, which includes still another first connection module 212 that is similar to yet different from the first connection modules 12 and 112 and that enables the vacuum interruption apparatus 204 to be connected with another piece of electrical equipment 220. That is, the piece of electrical equipment 220 includes a circuit 222 that includes a line side conductor 224 and a load side conductor 228 which have a different spacing than the line side and load side conductors 24 and 28 of the piece of electrical equipment 20.

The first connection module 212 is configured to include a first insulator 252 upon which are disposed a first connector 256 and a first terminal 260 that are electrically connected together via a first conduction element 268. The first connection module 212 is configured such that the terminal distance between the first terminal 260 and the second terminal 76 is of another first distance 288 which, in the depicted exemplary embodiment, is slightly shorter than the first distance 88.

It is reiterated that the vacuum interruption apparatus 204 in its third permutation still includes the vacuum interrupter 8A and the second connection module 16, and the first connector 256 is connected with the first electrode 44 of the vacuum interrupter 8 to form the vacuum interruption apparatus 204. As such, the piece of electrical equipment 220 which is different than the piece of electrical equipment 20 can be accommodated with the vacuum interruption apparatus 204 merely by providing, i.e., selecting from the component collection 36, the first connection module 212 in place of the first connection modules 12 and 112. It thus can be understood that the cost of forming a vacuum interruption apparatus that can accommodate the piece of electrical equipment 220 is merely that of providing the first connection module 212. This is far less than would be the cost to configure an entire vacuum interruption apparatus to accommodate the piece of electrical equipment 220.

A further exemplary fourth permutation of the vacuum interruption apparatus 304 is depicted generally in FIG. 6. The vacuum interruption apparatus 304 is similar to the vacuum interruption apparatus 204 but includes a different second connection module 316 in place of the second connection module 16. The vacuum interruption apparatus 304 is configured to be connected with another piece of electrical equipment 320 which includes a circuit 322 having a line side conductor 324 and a load side conductor 328 that are of the same terminal spacing 288 as the piece of electrical equipment 220. However, the piece of electrical equipment 320 includes a housing 332 having a different configuration and specifically has a ledge 398 that is of a different configuration than that of the piece of electrical equipment 220.

The second connection module 316 includes a second insulator 368 upon which are disposed a second connector 372 and a second terminal 376 that are electrically connected together via a second conduction element 380. The second connection module 316 further includes another drive mechanism 384 that is cooperable with the vacuum interrupter 8A to switch it between its OPEN and CLOSED conditions. The terminal distance between the first terminal 260 and the second terminal 376 is the same as the first distance 288 of the vacuum interruption apparatus 204. However, since the ledge 398 is spaced a relatively greater distance from the load side conductor 328, the external surface 396 of the second insulator 398 can be configured to give the second insulator 368 another physical dimension as measured between the second terminal 376 and the external surface 396 along the axis 90, which is relatively greater than the second distance 92. While the vacuum interruption apparatus 204 with the second connection module 16 could potentially be connected with the piece of electrical equipment 320, the relatively greater distance between the load side conductor 328 and the ledge 398 permits the second connection module 316 to be employed in place of the second connection module 16, if desired. For example, the second connection module 316 being relatively larger than the second connection module 16 may be less expensive to manufacture or may have greater heat dissipation or other desirable properties due to its increased size. Still alternatively, the piece of electrical equipment 320 may be configured such that the vacuum interruption apparatus 304 is intended to physically engage the ledge 398 whereby the external surface 396 is configured to permit such engagement.

Figure 2:
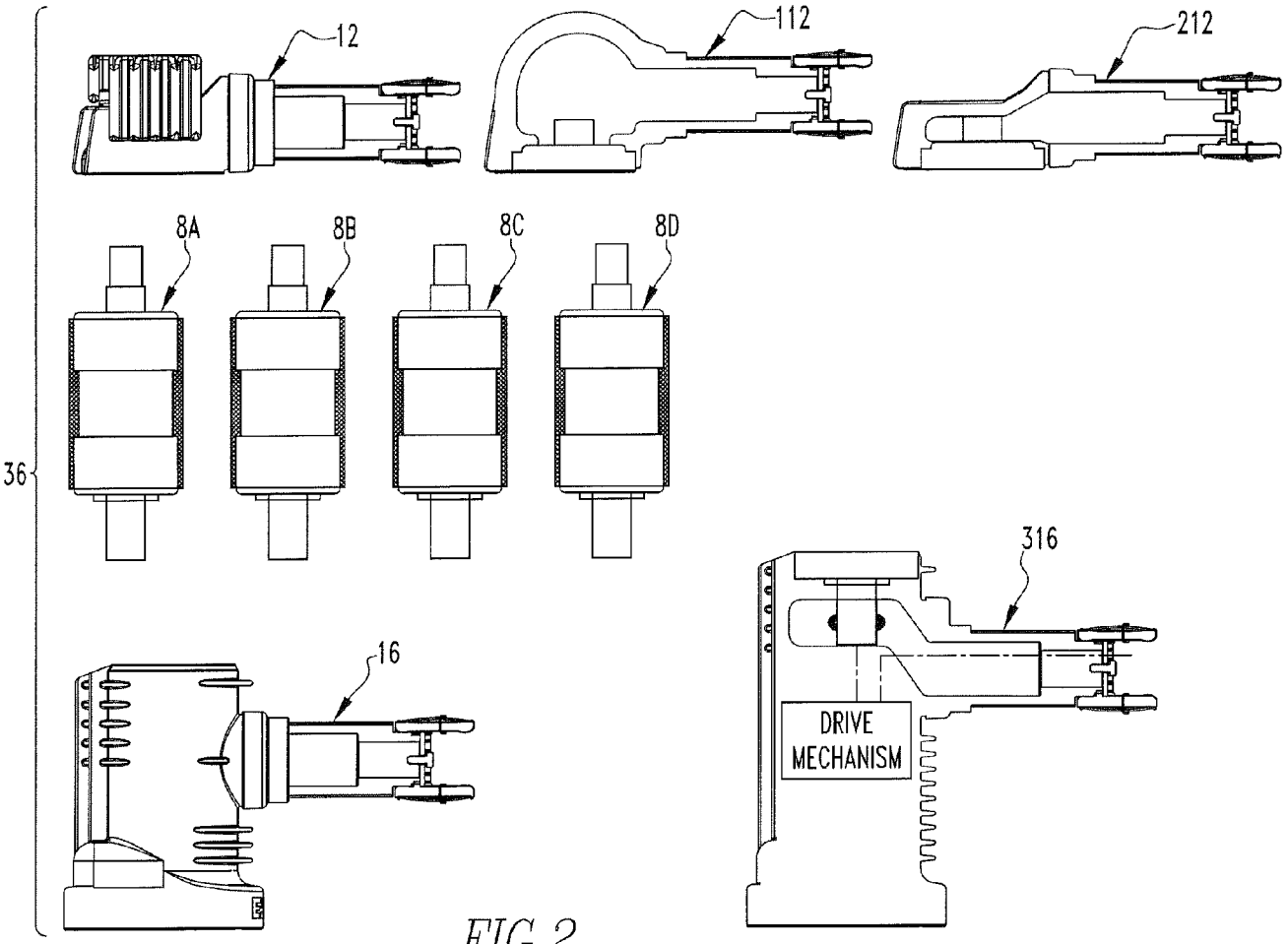
FIG. 2 is a schematic depiction of a component collection that includes various components that can be assembled and disassembled in various permutations to form different permutations of the modular vacuum interruption apparatus.

It therefore can be seen from the foregoing that any of the vacuum interrupters 8 can be combined with any of the first connection modules 12, 112, and 212 and with any of the second connection modules 16 and 316 in any combination to result in a permutation of the vacuum interruption apparatus that is suited to any particular application in any particular piece of equipment. In this regard, it is understood that by making the vacuum interruption apparatus modular in nature, a relatively small number of components, such as are depicted in the component collection component 36 in FIG. 2, can be assembled in different combinations to form a very large quantity of different vacuum interruption apparatuses having different physical dimensions and/or specifications and/or properties, four of which are depicted herein. The quantity of equipment that must be maintained in stock in any given operation is therefore advantageously reduced. Moreover, new applications can typically be accommodated by providing a single new component rather than an entire new vacuum interruption apparatus. The versatility afforded by the modular nature of the vacuum interruption apparatus, as is exemplified at the numerals 4, 104, 204, and 304, thus saves cost in numerous fashions.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A vacuum interruption apparatus that is structured to be electrically connected with an electrical circuit and that is movable between an OPEN condition and a CLOSED condition, the vacuum interruption apparatus comprising:

a vacuum interrupter having a first electrode and a second electrode;

a first connection module having a first insulator, a first connector, and a first terminal, the first connector and the first terminal being electrically connected together and being disposed on the first insulator, the first connector being electrically connected with the first electrode, the first terminal being structured to be electrically connected with one of a line side conductor and a load side conductor of the circuit;

a second connection module having a second insulator, a second connector, and a second terminal, the second connector and the second terminal being electrically connected together and being disposed on the second insulator, the second connector being electrically connected with the second electrode, the second terminal being structured to be electrically connected with the other of a line side conductor and a load side conductor of the circuit; and the first and second insulators being mechanically unconnected with one another;

wherein the vacuum interruption apparatus has a terminal spacing between the first and second terminals that is of a first distance; and wherein at least one of the first connection module and the second connection module is replaceable with a different connection module to cause the vacuum interruption apparatus to have a terminal spacing that is of a second distance different than the first distance.

2. The vacuum interruption apparatus of claim 1 wherein at least one of the first connection module and the second connection module is among a plurality of different connection modules that are interchangeably electrically connectable with the vacuum interrupter and that enable the vacuum interrupter to be electrically connected with different electrical circuits.

3. A vacuum interruption apparatus that is structured to be electrically connected with an electrical circuit and that is movable between an OPEN condition and a CLOSED condition, the vacuum interruption apparatus comprising:

a vacuum interrupter having a first electrode and a second electrode;

a first connection module having a first insulator, a first connector, and a first terminal, the first connector and the first terminal being electrically connected together and being disposed on the first insulator, the first connector being electrically connected with the first electrode, the first terminal being structured to be electrically connected with one of a line side conductor and a load side conductor of the circuit;

a second connection module having a second insulator, a second connector, and a second terminal, the second connector and the second terminal being electrically connected together and being disposed on the second insulator, the second connector being electrically connected with the second electrode, the second terminal being structured to be electrically connected with the other of a line side conductor and a load side conductor of the circuit;

the first and second insulators being mechanically unconnected with one another; and wherein the second connection module further comprises a drive mechanism that is operable to move the vacuum interrupter between its OPEN and CLOSED conditions.

4. The vacuum interruption apparatus of claim 3 wherein the vacuum interruption apparatus has a terminal spacing between the first and second terminals that is measured along an axis, and wherein the second insulator has a physical dimension as measured along the axis between the second terminal and an external surface of the second insulator, the second connection module being among a plurality of different second connection modules having different physical dimensions as measured along the axis that are interchangeably electrically connectable with the second electrode.

5. The vacuum interruption apparatus of claim 3 wherein the first and second insulators are spaced apart.

6. The vacuum interruption apparatus of claim 5 wherein at least a portion of the vacuum interrupter is disposed between the first and second connection modules.

7. The vacuum interruption apparatus of claim 1 wherein the first connector and the first terminal are each at least partially encapsulated in the first insulator, and wherein the second connector and the second terminal are each at least partially encapsulated in the second insulator.

8. A connection module structured to be electrically connected with an electrode of a vacuum interrupter that is movable between an OPEN condition and a CLOSED condition and that is structured to be electrically connected with an electrical circuit, the connection module comprising:

an insulator;

a connector;

a terminal;

the connector and the terminal being electrically connected together and being disposed on the insulator;

the connector being electrically connectable with the electrode and being electrically disconnectable from the electrode;

the terminal being structured to be electrically connected with one of a line side conductor and a load side conductor of the electrical circuit; and wherein the second connection module further comprises a drive mechanism that is operable to move the vacuum interrupter between its OPEN and CLOSED conditions.

9. The connection module of claim 8 wherein the connection module is among a plurality of different connection modules that are interchangeably electrically connectable with the electrode and that are electrically disconnectable from the electrode and that enable the vacuum interrupter to be electrically connected with different electrical circuits via the terminal.

10. The connection module of claim 8 wherein the insulator has a physical dimension as measured along an axis between the terminal and an external surface of the insulator, the connection module being among a plurality of different connection modules having different physical dimensions as measured along the axis that are interchangeably electrically connectable with the electrode and electrically disconnectable from the electrode.

11. The connection module of claim 8 wherein the connector and the terminal are each at least partially encapsulated in the insulator.

* * * * *